United States Patent [19]

Oberhofer et al.

[11] 3,962,109

[45] *June 8, 1976

[54] AUTOMOTIVE CLEANER PLUS INHIBITOR

[75] Inventors: Alfred W. Oberhofer, Downers Grove, Ill.; James J. Benko, Griffith, Ind.; Joseph C. Drozd, Park Ridge, Ill.

[73] Assignee: Nalco Chemical Company, Oak Brook, Ill.

[ * ] Notice: The portion of the term of this patent subsequent to May 25, 1993, has been disclaimed.

[22] Filed: Dec. 16, 1974

[21] Appl. No.: 533,356

[52] U.S. Cl. ..... 252/146; 252/74; 252/180; 252/387

[51] Int. Cl.[2] ..... C02B 5/00

[58] Field of Search ..... 252/146, 180, 387, 75, 252/74

[56] References Cited

UNITED STATES PATENTS

| | | | |
|---|---|---|---|
| 2,723,956 | 11/1955 | Johnson et al. | 252/181 |
| 2,802,788 | 8/1957 | Flaxman | 252/181 |
| 2,972,581 | 2/1961 | Johnson et al. | 252/75 |
| 2,994,664 | 8/1961 | Wachter | 252/146 |
| 3,079,343 | 2/1963 | Bernard | 252/75 |

*Primary Examiner*—Mayer Weinblatt
*Assistant Examiner*—Edith R. Buffalow
*Attorney, Agent, or Firm*—John G. Premo; John S. Roberts

[57] ABSTRACT

A cleaner-inhibitor and method of incorporating same into an automotive or diesel coolant system consisting of 2-4 fluid ounces per gallon of a cleaner whose basic components are:

A. An aminopolycarboxylic acid
B. An $\alpha$ hydroxy acid such as gluconic, tartaric, or citric
C. An azole copper protector such as mercaptobenzothiazole (MBT) and a monoaryl triazole such as benzotriazole or tolyltriazole wherein the ratio of A:B:C is about 3:1:1 to 2:1:1.

A, B, and C above constitute a Deposit Release Agent in the cleaner.

The cleaner above is combined with an inhibitor which is a multi-component inhibiting composition of the boron-nitrite type containing an alkali metal silicate and which may include a copper inhibitor and a polymeric dispersant, which is a water-soluble carboxylic acid polymer such as styrene maleic anhydride copolymer, a polyacrylate or methacrylate copolymer or carboxymethyl cellulose.

The cleaner-inhibitor is adjusted with caustic to give a pH in the range 7.5–12.6 and preferably 7.5–10.6 either by premix or directly to the coolant system.

An aqueous concentrate is preferred for both the cleaner portion and the inhibitor portion. In an aqueous concentrate of the cleaner the amount of Deposit Release Agent varies from about 85–15%, with a more preferred range being an aqueous concentrate which contains from 50–15% by weight of the Deposit Release Agent. In the inhibitor portion the aqueous concentrate contains 75–85% water and the balance active ingredients.

The cleaner is used in a dosage of about 4 ounces per gallon of coolant fluid and is combined with about 4 ounces per gallon of the multi-component corrosion inhibitor utilized above. In some instances under favorable conditions, the amount of the cleaner and inhibitor portions of the cleaner-inhibitor composition may each be reduced to 2 ounces per gallon of coolant.

18 Claims, No Drawings

AUTOMOTIVE CLEANER PLUS INHIBITOR

This invention is concerned with a cleaner-inhibitor for automotive or diesel coolant systems. This composition may be viewed as a two-part composition consisting of a cleaner portion and an inhibitor portion, each of which is utilized at a dosage of 2–4 fluid ounces per gallon of coolant where the coolant may be the commercially popular glycol type. The composition as a whole is also designed to be used co-extensively with the life of the coolant.

For an understanding of the mechanism of this composition and especially as to the cleaner portion, it is obvious that conventional approaches to engine cleaning to remove deposits is not entirely satisfactory and is almost prohibitive by the design of newer engines found in current modern cars. To remove successfully existing deposits from automotive cooling systems and engines, it is important that the nature of these deposits be understood, since they are relatively complex in nature. They may be divided into three categories.

The first category consists of scale which comes from hardness commonly found in waters used as make up for the coolant. Thus, insoluble compounds of calcium, barium, magnesium, and the like form insoluble salts, such as carbonates, silicates, phosphates, and the like, which often times form relatively tenacious scale on the heat transfer surfaces of automotive cooling systems.

The second category of deposits are in the form of corrosion products which are formed as the coolant circulates through the cooling system of the engine which always contains relatively copious quantities of oxygen, which presents to the cooling system a corrosive environment. These corrosion products are composed of a variety of oxides, metallic salts, and the like and often contain such elements as lead, iron, zinc, copper, and sometimes aluminum. These various corrosion products are occasioned by the fact that automotive cooling systems are not composed of any single metal. While the engine itself and certain portions of the radiator contain ferrous metals, other parts of the cooling system are composed of copper or copper alloys, aluminum, zinc, lead, and the like. Thus, galvanic-type cells are set up throughout the entire cooling system which further tends to increase the corrosiveness of the coolant towards the entire cooling system.

The third category of deposits are organic in nature and are composed of oils, greases and exhaust gases which always seep into the system due to the close association of the cooling system with the various lubricants used in the operation of internal combustion engines and the exhaust system. Another form of organic material which comprises the deposits of automotive cooling systems are the oxidation products of the common anti-freeze; e.g., ethylene or propylene glycol used in many automobiles producing largely acid breakdown products.

Thus, it is apparent that the deposits which tend to reduce heat transfer coefficients of automotive cooling systems are complex in nature and present an extremely difficult problem from the standpoint of cleaning and prevention. The problem of corrosion deposits is also accentuated by such factors as inhibitor depletion with time and temperature.

PRIOR ART

U.S. Pat. Nos. 2,723,956 Johnson (National Aluminate); Styrene maleic anhydride (SMA) for reducing scale in steam boilers.

2,802,788 Flaxman (Wilco); EDTA-type reagents for cleaning in an automotive cooling system utilized at an optimum pH of 7.0–7.5.

2,815,328 Green et al (Nalco); A basic corrosion inhibitor for diesel engine cooling systems.

2,877,188 Liddell (Hagan Chemicals); Mercaptobenzothiazole as a copper inhibitor.

2,972,581 Johnson et al (Nalco); A multi-component corrosion inhibiting composition for diesel and auto cooling systems.

3,079,343 Bernard (Pure Oil); Triethanolamine corrosion inhibitor and aminopolycarboxylic acid with glycol.

3,116,105 Kerst (Dearborn Chemical); Column 2 of the patent teaches aminopolycarboxylic acid together with a hydroxycarboxylic acid and a non-ionic surfactant utilized for corrosion inhibition.

3,419,501 Levy (Chrysler); Composition for cleaning the cooling system of an internal combustion engine and includes an aminopolycarboxylic acid.

3,645,402 Alexander et al (Mack Trucks); Disposable-type filter for an internal combustion engine having a canister containing a chemical corrosion inhibitor in a pallet preferably spun on to an adapter.

Defensive Publication T903,010 Katstra (Continental Oil); Non-ionic surfactant in combination with an alkaline cleaning compound or an aminopolycarboxylic acid.

THE CLEANER

The multi-purpose cleaner of the present invention, which is also designed both for efficiency and long life paralleling that of the coolant has the following basic components:

A. An aminopolycarboxylic acid
B. An $\alpha$ hydroxy acid such as gluconic, tartaric, or citric
C. An azole copper protector such as mercaptobenzothiazole (MBT) and a monoaryl triazole such as benzotriazole or tolyltriazole wherein the ratio of A:B:C is about 3:1:1 to 2:1:1.

In the above, A, B, and C constitute a Deposit Release Agent in the cleaner.

A preferred central part of the present cleaner consists of the following composition:

A. An aminopolycarboxylic acid (e.g., EDTA)
B. An $\alpha$ hydroxy acid (e.g., sodium gluconate)
C. A copper protector selected from mercaptobenzothiazole (MBT) and a monoaryl triazole
D. An oil-in-water emulsifying agent An aqueous concentrate is preferred and in such a concentrate the amount of Deposit Release Agent varies from about 85–15% with a more preferred range being an aqueous concentrate which contains from 50–15% by weight of the Deposit Release Agent. The balance of such concentrate is, of course, water, preferably soft water. The aqueous concentrates above are adjusted with the water-soluble basic material to give a pH of about 7.5–12.6 with a preferred pH 7.5–10.6.

In addition to the Deposit Release Agent noted above, the following components are necessary in some of the cleaner formulations of this invention.

1. In order to emulsify by water, an oil-in-water emulsifying agent is utilized (D), such as Triton CF 10 (Rohm and Haas), an ethoxylated nonylphenol with an average of 9 EtO.

2. A reducing agent to reduce iron from $Fe^{+++}$ to $Fe^{++}$ is also present and a preferred reducing agent is thioglycolic acid or one of its soluble alkali metal salts.

3. Also present in some of the cleaner compositions is a polymeric dispersant which may be a water-soluble carboxylic acid polymer, a vinyl addition polymer, or carboxymethyl cellulose. A preferred polymer is the copolymer of styrene maleic anhydride and these polymers have a molecular weight of 1,000 to 1,000,000 and preferably 100,000 or less.

4. As a brightener or film former for solder an aminoalkanol is utilized preferably diethylaminoethanol.

Additionally, a minor quantity of antifoams and dyes may be used in an optional manner as indicated.

The Aminopolycarboxylic Acid.

The aminopolycarboxylic acid of the Deposit Release Agent may be used as an alkali metal salt and is selected from Versene Na-4 (Dow Chemical—EDTA, ethylenediaminetetraacetic acid, where 4 hydrogens are replaced by sodium); Versene Fe-3 (Dow Chemical—EDTA where 3 hydrogens have been replaced by $Fe_3$); HEDTA (N-hydroxyethyl-N,N′, N′-ethylenediaminetriacetic acid); DTPA (N,N,N′, N″, N″-diethylenetriaminepentaacetic acid); and NTA (nitrilotriacetic acid). The free acid and soluble alkali metal salts may both be utilized.

The purpose of the aminopolycarboxylic acids is to slowly solubilize non-ferrous metals contained in the deposits such as lead, calcium, magnesium, zinc, and copper. Thus, the aminopolycarboxylic acid most accurately is operating on hardness deposits and corrosion products, especially of lead, zinc, and copper metals noted above which are present.

The $\alpha$ Hydroxy Acid.

The $\alpha$ hydroxy acid, which may be also described as a hydroxycarboxylic acid and in the case of citric acid as a hydroxypolycarboxylic acid, is utilized in lesser amounts than the amino acids above. The free acid and soluble alkali metal salts may both be utilized. These materials also tend to slowly solubilize the non-ferrous and ferrous metal portions of the deposits and place them into solution or in the form of a finely divided suspension.

Azole Copper Protector.

Also, in the Deposit Release Agent and utilized in a minor amount with respect to the aminopolycarboxylic acid above is a special azole protector for copper, which may be mercaptobenzothiazole (MBT) which is relatively slow acting and fragile, and monoaryl triazole such as benzotriazole or tolyltriazole which is selected for rapid action and filming.

In a preferred formulation, as a copper film former, a mixture of mercaptobenzothiazole (MBT) and one of the monoaryl triazoles are utilized, since the latter are more soluble and more stable. Due to the increased heat in the automotive cooling system, it has been found that greater stability is achieved by utilizing these more heat stable compounds in lieu of the more heat fragile mercaptobenzothiazole. Thus, a portion of the MBT conventionally used is retained by a split dosage with one of the monoaryl triazoles, such as tolyltriazole, and this split dosage is used to take advantage of the more rapid action of MBT in an optimum formulation. A formulation of equiparts by weight percent of MBT and a monoaryl triazole has been found especially useful.

The purpose of this material is to prevent any possible deposition of copper back onto ferrous metal surfaces which deposition would cause excessive corrosion of such surfaces due to the highly galvanic nature of such dissimilar metals in contact with each other in a corrosive aqueous environment.

Oil-in-Water Emulsifier.

An important component utilized in conjunction with the Deposit Release agent is an oil-in-water emulsifying agent. The purpose of this surfactant is to emulsify the organic components of the deposit into the aqueous coolant. By so emulsifying the organic portions of the deposit, it is possible to substantially loosen many types of deposits. By maintaining the organic portions of the deposits as an emulsion, it prevents them from replating out onto the heat transfer surfaces in forming hydrocarbon crusts which are heat insulators in nature and form localized hot spots within the system which cause possible burn out or metal deterioration. Typical of such materials are low foaming surfactants, such as Triton CF 10 (Rohm and Haas), and ethoxylated nonylphenol with an average of 9 EtO; and one or more antifoams such as Ucon Lub 50 HB-5100 (Union Carbide), which is a polyoxyalkylene glycol.

In addition to the above, minor amounts of silicone-type antifoams may be used.

Reducing Agent.

A reducing agent may be incorporated into the formula to assist in reducing iron from $Fe^{+++}$ to the more soluble $Fe^{++}$; and to reduce transition elements, thioglycolic acid (or a similar organo mercapto carboxylic acid homolog such as mercapto propionic acid) or one of its soluble basic salts is preferred. As alternatives, other reducing agents may be substituted such as sodium thiosulfate ($Na_2S_2O_3$), sodium bisulfite ($NaHSO_3$), sodium hydrosulfite ($Na_2S_{2-4}\cdot 2H_2O$, dithionate, hyposulfite), sodium sulfite ($Na_2SO_3$), sodium sulfide, hydrazine, and stannous chloride.

Polymeric Dispersants.

The polymeric dispersants may be generically categorized, may be a water-soluble carboxylic acid polymer, and may be a vinyl addition polymer or carboxymethyl cellulose (CMC). Of the vinyl addition polymers contemplated, maleic anhydride copolymers as with vinyl acetate, styrene, ethylene, isobutylene, and vinyl ethers are preferred.

All of the above-described polymers are water-soluble or at least colloidally dispersible in water. The molecular weight of these polymers may vary over a broad range although it is preferred to use polymers having average molecular weights ranging between 1,000 up to 1,000,000. In a most preferred embodiment of the invention these polymers have a molecular weight of 100,000 or less. While higher molecular weight polymers may be used, there is no particular advantage in their utilization because they tend to be broken down due to the shear forces found in recirculating cooling systems. Also, when used in larger amounts in concentrated formulas, they produce highly viscous products that are difficult to use.

The water-soluble polymers of the type described above are often in the form of copolymers which are contemplated as being useful in the practice of this invention provided they contain at least 10% by weight of

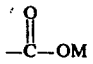

groups where M is hydrogen, alkali metal, ammonium or other water-solubilizing radicals. The polymers or copolymers may be prepared by either addition or hydrolytic techniques. Thus, maleic anhydride copolymers are prepared by the addition polymerization of maleic anhydride and another comonomer such as styrene. The low molecular weight acrylic acid polymers may be prepared by addition polymerization of acrylic acid or its salts either with itself or other vinyl comonomers. Alternatively, such polymers may be prepared by the alkaline hydrolysis of low molecular weight acrylonitrile homopolymers or copolymers. For such a preparative technique see Newman U.S. Pat. No. 3,419,502.

In the case of carboxymethyl cellulose, cellulose is modified with chloroacetic acid to graft carboxylic acid moieties onto the cellulose backbone.

As previously stated, maleic anhydride polymers are preferred. Especially useful maleic anhydride polymers are selected from the group consisting of homopolymers of maleic anhydride, and copolymers of maleic anhydride with vinyl acetate, styrene, ethylene, isobutylene and vinyl ethers. These polymers can be easily prepared according to standard methods of polymerization.

The polymeric dispersants aid in maintaining any nonsolubilized deposit removed by the Deposit Release Agent in a very finely divided state of subdivision. This prevents redeposition of such non-solubilized deposits, thus aiding in maintaining the heat transfer surfaces of the cooling system in good condition.

A Brightener.

Additionally, a brightener or film former for solder is advantageous in the composition and for this purpose a minor percentile of an alkanolamine, preferably a dialkylaminoalkanol, is optionally utilized. Specifically a compound is used where the alkyl group is lower alkyl ($C_1$-$C_6$) and a specific example of such a solder protector is diethylaminoethanol.

Exemplary formulations illustrating the cleaner portion of the present invention are set out below. Numerical values are percent by weight.

| | |
|---|---|
| Formula I | |
| Deposit Release Agent | 85–98 |
| Surfactant | 15–2 |
| Formula II | |
| Deposit Release Agent | 75–90 |
| Surfactant | .5–5 |
| Reducing Agent | 5–20 |
| Formula III | |
| Deposit Release Agent | 65–90 |
| Surfactant | .5–5 |
| Reducing Agent | 5–15 |
| Polymeric Dispersant | .5–10 |
| Formula IV | |

-continued

| | |
|---|---|
| Deposit Release Agent | 50–80 |
| Surfactant | .5–5 |
| Reducing Agent | 5–15 |
| Polymeric Dispersant | .5–10 |
| Aminoalkanol | 5–20 |

As previously indicated, the above materials are dissolved in water to provide an aqueous concentrate which contains from 15–85% and preferably 15–50% by weight of the above formulas.

THE INHIBITOR PORTION

The inhibitor which is utilized comprises as mandatory ingredients boron or a borax compound, a nitrite, and additionally an alkali silicate. Such boron-nitrite inhibitors are well known and are described at page 144–153 of Bregman, *Corrosion Inhibitors*, McMillan Company, 1970. This type of inhibitor utilized may additionally include an azole copper protector and a polymeric dispersant.

A preferred inhibitor is utilized in about equal weight percent with the cleaner portion in the composition. The inhibitor also is preferably used as an aqueous composition which contains from 75–85% water and preferably 25–15% of the inhibitor portion.

A typical inhibitor portion comprises:

E. Borax

F. Alkali metal nitrite

G. Alkali metal silicate with a ratio of E:F:G being in the range of from 10:3:5 to 1:1:1

A specific inhibitor, also designed for co-extending and long life of the coolant to which it is added, is represented by the following Formula X:

FORMULA X

| Necessary | Percent |
|---|---|
| Soft Water | 75–85 |
| Borax | 1–10 |
| Alkali Metal Nitrite | 1–3 |
| Alkali Metal Silicate | 1–5 |
| Other | |
| Alkali Metal Hydroxide (50% by wt. caustic) | 2.5–3.5 |
| Azole Copper Protector | .5–1.5 |
| Polymeric Dispersant | .2–1.5 |
| Sodium Oleate | 1–3 |
| Sodium Carbonate | 1–3 |
| Antifoam | .05–.1 |
| Alkanolamine (i.e., DEAE) | .5–1 |
| Dye | .05–.1 |

In the above formula, the necessary ingredients are:

Borax.

The use of borax and similar boron compounds of metaborate and tetraborate, such as alkali metal derivatives, are helpful in a recirculating water system by inhibiting steel and zinc and additionally supplying buffering capacity in alkaline pH's.

Alkali Metal Nitrite.

Sodium nitrite and potassium nitrite are utilized to inhibit corrosion of iron and other metals. These components are most efficient in the alkaline range.

Alkali Metal Silicate.

Potassium and sodium silicates are preferred. The alkali silicates, such as sodium metasilicate, also provide one source of buffering for the acids produced from the glycol antifreeze in the system. Prime anticorrosion targets for the silicates utilized in the present compositions are aluminum, iron, and solder, and here the silicate is believed to operate by thin film protection best at the alkaline pH targeted for the compositions of the present invention.

In this specification the term "alkali metal" is limited to the commercially feasible members comprising sodium and potassium, and MeOH designates alkali metal hydroxide.

Relative to the remaining components of inhibitor Formula X, the alkali metal hydroxides and carbonates are utilized as pH regulators. The azole copper protector, the polymeric dispersant, and the alkanolamine, for example DEAE (diethylaminoethanol), have been previously described as components in the cleaner portion. Of the remaining ingredients, sodium oleate is used for emulsifying purposes; the use of the antifoam and the use of the dye are conventional.

pH OF THE COMPOSITION

The pH of the cleaner-inhibitor is specially selected and adjusted (by alkaline carbonates and hydroxides) for an alkaline in-use range of between 7.5–12.6, preferably between 7.5–10.6, with an optimum value of 10.6.

The supplemental alkalinity in the present composition serves to combat the thermal and chemical decomposition engendered by the higher skin temperatures of heat transfer surfaces in the passenger car engine and the normally higher temperatures encountered in trucks. It is noted that Bregman, ante, states at pages 144–145 that conventionally the boron-nitrite inhibitors are used at a pH range of 8.5–9.5 usually by a buffer combination of borax and sodium nitrite. The supplemental alkalinity of these compositions also works to increase the time in use, making changes of coolant fluid more infrequent despite the higher temperature operating conditions.

FORM AND DOSAGE

The format for including the cleaner inhibitor in the automobile coolant system is either liquid or semi-solid and the composition is utilized in a dosage of 2–4 fluid ounces each of cleaner and inhibitor per gallon of coolant with a preferred dosage of 8 total fluid ounces per gallon of coolant.

For shipping and installation, a compact unit together with a solids filter is preferred and an example where the chemical container is spun on to a ratchet in the filter is noted in U.S. Pat. No. 3,645,402 Alexander, noted ante. Such a compact unit solves many of the problems arising in current cooling systems by raising the pH to at least 10.4–10.8, supplying more inhibitor and removing suspended precipitates from antifreeze by means of a filter.

In the present specification where the word "solid" appears, it is intended to denote both a cleaner and inhibitor fraction where the bulk of the water has been removed as for shipping purposes or installation of a filter.

EXAMPLE 1

Formula Y

A preferred embodiment of multicomponent cleaner for use in automotive coolants is the following Formula Y:

| Mix Order | Components | Wt.% |
|---|---|---|
| 1 | Soft Water (0.2 gpg TH) | 82.67 |
| 2* | Caustic, 50% solution calculated as 100% | 2.40 |
| 3 | Tolyltriazole, Solid | 1.00 |
| 4 | Mercaptobenzothiazole, Solid | 1.00 |
| 5 | Triton CF-10 (Rohm and Haas) Ethoxylated Nonylphenol (9 EtO) | 0.20 |
| 6 | Styrene Maleic Anhydride (mix for at least 45 minutes before adding the next component) | 0.50 |
| 7 | Sodium Gluconate 50%, calculated as 100% | 2.10 |
| 8 | Diethylaminoethanol | 1.20 |
| 9 | EDTA 82%, calculated as 100% | 5.00 |
| 10 | Thioglycolic Acid | 1.00 |
| 11 | Borax, 5 mol $H_2O$ (mix for at least 15 minutes before adding the next component) | 1.25 |
| 12 | Sodium Nitrite | 1.50 |
| 13 | Ucon Lub 50 HB 5100 (Union Carbide) | 0.10 |
| 14 | Antifoam, Dow A, Silicone (Dow Chemical) | 0.05 |
| 15 | Dye, Uranine C (Dow Chemical) | 0.03 |

*Advantageous to withhold 1% of caustic. Add the remaining components and then check solution pH. Then adjust the pH of the batch to 12.6.

Generalized procedure for Formula Y.

Each component was added in the mixing order shown above for Y and each component was completely dissolved before the next sequential one was added. In the mixing, the water temperature was regulated to 120°F or below. Water hardness was also regulated to 0.2 grams per gallon of hardness or better. The mixing time, including step-by-step addition, was not less than 3 hours and an interval of 5 minutes was observed between adding each component. In the case of the styrene maleic anhydride, which dissolves slowly, the mixture was stirred for 45 minutes before the next addition and lump formation was avoided by slow and careful addition of the polymer to the mix.

EXAMPLE 2

A liquid corrosion inhibitor which exhibited a make up pH of 12–12.5 and a use pH of about 10.6 was prepared by utilizing the components below in the order of addition noted to produce a liquid product:

| | |
|---|---|
| Water (preferably soft or deionized water) | 81.2 % |
| Antifoam (Ucon 50 HB 5100-polyalkylene glycol) | 0.1 % |
| Alkali metal hydroxide (50% by wt. caustic) | 2.7 % |
| Benzotriazole as copper inhibitor | 0.5 % |
| Mercaptobenzothiazole as copper inhibitor | 0.5 % |
| Borax | 6.0 % |
| Sodium metasilicate | 3.5 % |
| Sodium nitrite | 3.0 % |
| Styrene maleic anhydride | 0.5 % |
| Dye | .08% |
| Sodium polyacrylate | 0.3 % |

An additional experiment utilized tolyltriazole for benzotriazole in the above formulation and further experiments added 2 percent of sodium oleate as a solder protector and 1 percent of dialkylaminoethanol also as a solder protector. The necessary ingredients were varied within the limits set out in the formula of the specific inhibitor, ante.

EXAMPLE 3

Four ounces per gallon of the cleaner of Example 1 and the corrosion inhibitor of Example 2 were each placed in the 4½ gallon coolant system of a 1973 Chevrolet Caprice showing an initial mileage of 5,000. Corrosion tests by coupons and clean metal by observation were observed for three 6-month periods and the observations were satisfactory.

EXAMPLE 4

Twenty-two ounces of a cleaner composition was utilized in accordance with the following formula (in a 5½ gallon coolant system of a 1972 Eldorado):

| | | Wt.% |
|---|---|---|
| I. | Deposit Release Agent, see A, B, C, ante | 6.0 |
| II. | Surfactant, oil-in-water type | .2 |
| III. | Reducing Agent, thioglycolic acid | 1.0 |
| IV. | Polymeric Scale Suppressant, styrene/maleic anhydride copolymer | .5 |
| V. | Aminoalkanol, diethylaminoethanol | 1.2 |

Additionally, 22 ounces of the inhibitor additive to the above cleaner was utilized and said inhibitor additive had the following composition:

| | |
|---|---|
| Antifoam (Ucon 50 HB 5100-polyalkylene glycol) | 0.5 |
| Alkali metal hydroxide (50% by wt. caustic) | 13.5 |
| Benzotriazole as copper inhibitor | 2.5 |
| Mercaptobenzothiazole as copper inhibitor | 2.5 |
| Borax | 30.0 |
| Sodium metasilicate | 17.5 |
| Sodium nitrite | 15.0 |
| Styrene maleic anhydride | 2.5 |
| Dye | .4 |
| Sodium polyacrylate | 1.5 |

Example 5

Twelve ounces of the cleaner set out in Example 4 plus 12 ounces of the inhibitor additive were made up into a chemical package or pellet and placed into a disposable-type filter particularly adapted for use in the cooling systems of automobile engines. The filter was inserted into the cooling system of a 1968 standard Thunderbird (Ford Motor Company) and the filter was changed every 6 months to observe precipitate and general condition of the coolant which proved satisfactory. The filter is available commercially from Mack Trucks, Inc., and is further described in U.S. Pat. No. 3,645,402 Alexander.

What is claimed is:

1. A liquid cleaner-inhibitor composition for automotive cooling systems consisting essentially of:

I. A cleaner portion consisting essentially of from 15–85% by weight of water and from 85–15% by weight of a Deposit Release Agent consisting essentially of:

A. An aminopolycarboxylic acid

B. An $\alpha$ hydroxy carboxylic acid

C. An azole copper protector selected from the group consisting of mercaptobenzothiazole and a monobenzotriazole with the ratio of A:B:C being within the range of from 3:1:1 to 2:1:1 and

II. An inhibitor portion consisting essentially of from 75–85% by weight of water and from 25–15% by weight of:

E. Borax or alkali metal borate

F. Alkali metal nitrite

G. Alkali metal silicate with a ratio of E:F:G being in the range of from 10:3:5 to 1:1:1 said composition having a pH of 7.5–12.6.

2. A liquid cleaner-inhibitor composition for automotive cooling systems consisting essentially of:

I. A cleaner portion consisting essentially of from 15–85% by weight of water and from 85–15% by weight of a Deposit Release Agent consisting essentially of:

A. An aminopolycarboxylic acid

B. An $\alpha$ hydroxy carboxylic acid

C. An azole copper protector selected from the group consisting of mercaptobenzothiazole and a monobenzotriazole; and D. A non-ionic oil-in-water emulsifier with the ratio of A:B:C being within the range of from 3:1:1 to 2:1:1 and

II. An inhibitor portion consisting essentially of from 75–85% by weight of water and from 25–15% by weight of:

E. Borax or alkali metal borate

F. Alkali metal nitrite

G. Alkali metal silicate with a ratio of E:F:G being in the range of from 10:3:5 to 1:1:1 said composition having a pH of 7.5–12.6, wherein said cleaner portion and said inhibitor portion are about equipart in weight percent of the composition.

3. A liquid cleaner-inhibitor composition for automotive cooling systems consisting essentially of:

I. A cleaner portion consisting essentially of from 15–85% by weight of water and from 85–15% by weight of a Deposit Release Agent consisting essentially of:

A. An aminopolycarboxylic acid

B. An $\alpha$ hydroxy carboxylic acid

C. An azole copper protector selected from the group consisting of mercaptobenzothiazole and a monobenzotriazole; and D. A non-ionic oil-in-water emulsifier with the ratio of A:B:C being within the range of from 3:1:1 to 2:1:1 and

II. An inhibitor portion consisting essentially of:

| | Percent |
|---|---|
| Soft Water | 75–85 |
| Borax | 1–10 |
| Alkali Metal Nitrite | 1–3 |
| Alkali Metal Silicate Optional | 1–5 |
| Alkali Metal Hydroxide (50% by wt. caustic) | 2.5–3.5 |
| Azole Copper Protector selected from the group consisting of mercaptobenzothiazole and a monobenzotriazole | .5–1.5 |
| Polymeric Dispersant which is a water-soluble carboxylic acid polymer having an average molecular weight between 1,000 to 1,000,000 | .2–1.5 |
| Sodium Oleate | 1–3 |
| Sodium Carbonate | 1–3 |
| Antifoam | .05–.1 |
| Alkanolamine where the number of carbons in the alkanol chain is $C_1$–$C_6$ | .5–1 |
| Dye | .05–.1 |

said composition having a pH of 7.5–12.6, wherein said cleaner portion and said inhibitor portion are about equipart in weight percent of the composition.

4. The composition according to claim 1 wherein the composition has a pH of 7.5–10.6.

5. The composition according to claim 2 wherein the composition has a pH of 7.5–10.6.

6. The composition according to claim 3 wherein the composition has a pH of 7.5–10.6.

7. A method of cleaning metal surfaces and inhibiting corrosion in automotive coolant systems which comprises adding thereto 2–4 fluid ounces per gallon of coolant each of a two-portion composition consisting essentially of the following:

I. A cleaner portion consisting essentially of from 15–85% by weight of water and from 85–15% by weight of a Deposit Release Agent consisting essentially of:

A. An aminopolycarboxylic acid

B. An $\alpha$ hydroxy carboxylic acid

C. An azole copper protector selected from the group consisting of mercaptobenzothiazole and a monobenzotriazole with the ratio of A:B:C being within the range of from 3:1:1 to 2:1:1 and

II. An inhibitor portion consisting essentially of from 75–85% by weight of water and from 25–15% by weight of:

E. Borax or alkali metal borate

F. Alkali metal nitrite

G. Alkali metal silicate with a ratio of E:F:G being in the range of from 10:3:5 to 1:1:1 said composition having a pH of 7.5–12.6.

8. A method of cleaning metal surfaces and inhibiting corrosion in automotive coolant systems which comprises adding thereto 2–4 fluid ounces per gallon of coolant each of a two-portion composition consisting essentially of the following:

I. A cleaner portion consisting essentially of from 15–85% by weight of water and from 85–15% by weight of a Deposit Release Agent consisting essentially of:

A. An aminopolycarboxylic acid

B. An $\alpha$ hydroxy carboxylic acid

C. An azole copper protector selected from the group consisting of mercaptobenzothiazole and a monobenzotriazole; and D. A non-ionic oil-in-water emulsifier with the ratio of A:B:C being within the range of from 3:1:1 to 2:1:1 and

II. An inhibitor portion consisting essentially of from 75–85% by weight of water and from 25–15% by weight of:

E. Borax or alkali metal borate

F. Alkali metal nitrite

G. Alkali metal silicate with a ratio of E:F:G being in the range of from 10:3:5 to 1:1:1 said composition having a pH of 7.5–12.6.

9. A method of cleaning metal surfaces and inhibiting corrosion in automotive coolant systems which consisting essentially of adding thereto 2–4 fluid ounces per gallon of coolant each of a two-portion composition consisting essentially of the following:

I. A cleaner portion consisting essentially of from 15–85% by weight of water and from 85–15% by weight of a Deposit Release Agent consisting essentially of:

A. An aminopolycarboxylic acid

B. An $\alpha$ hydroxy carboxylic acid

C. An azole copper protector selected from the group consisting of mercaptobenzothiazole and a monobenzotriazole; and D. A non-ionic oil-in-water emulsifier with the ratio of A:B:C being within the range of from 3:1:1 to 2:1:1 and

II. An inhibitor portion comprising:

| | Percent |
|---|---|
| Soft Water | 75–85 |
| Borax | 1–10 |
| Alkali Metal Nitrite | 1–3 |
| Alkali Metal Silicate | 1–5 |
| Optional | |
| Alkali Metal Hydroxide (50% by wt. caustic) | 2.5–3.5 |
| Azole Copper Protector selected from the group consisting of mercaptobenzothiazole and a monobenzotriazole | .5–1.5 |
| Polymeric Dispersant which is a water-soluble carboxylic acid polymer having an average molecular weight between 1,000 to 1,000,000 | .2–1.5 |
| Sodium Oleate | 1–3 |
| Sodium Carbonate | 1–3 |
| Antifoam | .05–.1 |
| Alkanolamine where the number of carbons in the alkanol chain is $C_1$–$C_6$ | .5–1 |
| Dye | .05–.1 |

said composition having a pH of 7.5–12.6.

10. The method according to claim 7 wherein the composition has a pH of 7.5–10.6.

11. The method according to claim 8 wherein the composition has a pH of 7.5–10.6.

12. The method according to claim 9 wherein the composition has a pH of 7.5–10.6.

13. A glycol coolant for automotive cooling systems which consisting essentially of additionally 2–4 ounces per gallon of coolant each of a cleaner portion and an inhibitor portion of a composition consisting essentially of:

I. A cleaner portion consisting essentially of from 15–85% by weight of water and from 85–15% by weight of a Deposit Release Agent consisting essentially of:

A. An aminopolycarboxylic acid

B. An $\alpha$ hydroxy carboxylic acid

C. An azole copper protector selected from the group consisting of mercaptobenzothiazole and a monobenzotriazole with the ratio of A:B:C being within the range of from 3:1:1 to 2:1:1 and

II. An inhibitor portion consisting essentially of from 75–85% by weight of water and from 25–15% by weight of:

E. Borax or alkali metal borate

F. Alkali metal nitrite

G. Alkali metal silicate with a ratio of E:F:G being in the range of from 10:3:5 to 1:1:1 said composition having a pH of 7.5–12.6.

14. A glycol coolant for automotive cooling systems which consisting essentially of additionally 2–4 ounces per gallon of coolant each of a cleaner portion and an inhibitor portion of a composition consisting essentially of:

I. A cleaner portion consisting essentially of from 15–85% by weight of water and from 85–15% by weight of a Deposit Release Agent consisting essentially of:

A. An aminopolycarboxylic acid

B. An $\alpha$ hydroxy carboxylic acid

C. An azole copper protector selected from the group consisting of mercaptobenzothiazole and a monobenzotriazole; and D. A non-ionic oil-in-water emulsifier with the ratio of A:B:C being within the range of from 3:1:1 to 2:1:1 and

II. An inhibitor portion consisting essentially of from 75–85% by weight of water and from 25–15% by weight of:

E. Borax or alkali metal borate

F. Alkali metal nitrite

G. Alkali metal silicate with a ratio of E:F:G being in the range of from 10:3:5 to 1:1:1 said composition having a pH of 7.5–12.6.

15. A glycol coolant for automotive cooling systems which consisting essentially of additionally 2–4 ounces per gallon of coolant each of a cleaner portion and an inhibitor portion of a composition consisting essentially of:

I. A cleaner portion consisting essentially of from 15–85% by weight of water and from 85–15% by weight of a Deposit Release Agent consisting essentially of:

A. An aminopolycarboxylic acid

B. An $\alpha$ hydroxy carboxylic acid

C. An azole copper protector selected from the group consisting of mercaptobenzothiazole and a monobenzotriazole; and D. A non-ionic oil-in-water emulsifier with the ratio of A:B:C being within the range of from 3:1:1 to 2:1:1 and

II. An inhibitor portion consisting essentially of:

| | Percent |
|---|---|
| Soft Water | 75–85 |
| Borax | 1–10 |
| Alkali Metal Nitrite | 1–3 |
| Alkali Metal Silicate | 1–5 |
| Optional | |
| Alkali Metal Hydroxide (50% by wt. caustic) | 2.5–3.5 |
| Azole Copper Protector selected from the group consisting of mercaptobenzothiazole and a monobenzotriazole | .5–1.5 |
| Polymeric Dispersant which is a water-soluble carboxylic acid polymer having an average molecular weight between 1,000 to 1,000,000 | .2–1.5 |
| Sodium Oleate | 1–3 |
| Sodium Carbonate | 1–3 |
| Antifoam | .05–.1 |
| Alkanolamine where the number of carbons in the alkanol chain is $C_1$–$C_6$ | .5–1 |
| Dye | .05–.1 |

said composition having a pH of 7.5–12.6.

16. The coolant according to claim 13 wherein the composition has a pH of 7.5–10.6.

17. The coolant according to claim 14 wherein the composition has a pH of 7.5–10.6.

18. The coolant according to claim 15 wherein the composition has a pH of 7.5–10.6.

* * * * *